US010286535B2

(12) United States Patent
Moore et al.

(10) Patent No.: US 10,286,535 B2
(45) Date of Patent: May 14, 2019

(54) VALVE BODY CHARGE LOCK

(71) Applicant: Caterpillar Inc., Peoria, IL (US)

(72) Inventors: Cody Moore, Waco, TX (US); Joshua Grzybowski, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 426 days.

(21) Appl. No.: 15/085,794

(22) Filed: Mar. 30, 2016

(65) Prior Publication Data

US 2017/0282343 A1 Oct. 5, 2017

(51) Int. Cl.

| | |
|---|---|
| ***B25D 9/00*** | (2006.01) |
| ***B25D 9/12*** | (2006.01) |
| ***E02F 3/96*** | (2006.01) |
| ***B25D 17/24*** | (2006.01) |

(52) U.S. Cl.

CPC ..... *B25D 9/00* (2013.01); *B25D 9/12* (2013.01); *B25D 17/245* (2013.01); *E02F 3/966* (2013.01); *B25D 2250/065* (2013.01); *E02F 3/963* (2013.01)

(58) Field of Classification Search

CPC ..... B25D 2209/005; B25D 2209/007; B25D 2250/035; B25D 2250/065; B25D 2250/121

USPC ..... 173/9; 251/94

See application file for complete search history.

(56) References Cited

U.S. PATENT DOCUMENTS 4,189,917 A 2/1980 Gunning
4,263,801 A * 4/1981 Gregory ..... B21J 15/205 29/243.524
4,474,248 A * 10/1984 Musso ..... B25D 9/12 173/17
4,498,293 A * 2/1985 Gregory ..... F15B 15/204 144/195.1
4,689,957 A * 9/1987 Gallentine ..... B25B 1/18 60/477
4,735,048 A * 4/1988 Gregory ..... B21J 15/105 417/443
4,745,981 A * 5/1988 Buske ..... B25D 9/145 173/202
4,819,542 A * 4/1989 Fadeev ..... B25D 9/12 91/172

(Continued)

FOREIGN PATENT DOCUMENTS

| | | |
|---|---|---|
| EP | 0080964 | 6/1983 |
| GB | 2010714 | 7/1979 |
| WO | 9702386 | 1/1997 |

OTHER PUBLICATIONS

INDECO; "HP Series Service Manual", service manual, published Feb. 21, 2012 in the United States, 64 pages.

(Continued)

*Primary Examiner* — Andrew M Tecco
*Assistant Examiner* — Praachi M Pathak
(74) *Attorney, Agent, or Firm* — Law Office of Kurt J. Fugman LLC

(57) ABSTRACT

A method of regulating the disassembly of a component from a powered tool assembly that uses a pressurized fluid and a locking member that is in operative association or communication with the fluid is provided. The method comprises biasing the locking member into a locked configuration using the pressurized fluid, preventing movement of the component in a first predetermined direction.

4 Claims, 6 Drawing Sheets

(56) References Cited

U.S. PATENT DOCUMENTS

| | | | | |
|---|---|---|---|---|
| 5,320,187 | A * | 6/1994 | Pressley | B25D 17/04 173/15 |
| 5,425,164 | A * | 6/1995 | El Dessouky | B21J 15/205 29/243.524 |
| 7,007,712 | B2 * | 3/2006 | Anderson | B25D 9/14 137/383 |
| 7,290,622 | B2 * | 11/2007 | Keskiniva | B25D 9/22 173/200 |
| 7,753,136 | B2 | 7/2010 | Lu | |
| 8,794,347 | B2 | 8/2014 | Rodert et al. | |
| 8,794,589 | B2 * | 8/2014 | Arnold | F16K 31/1225 251/14 |
| 9,108,311 | B2 * | 8/2015 | Keskiniva | B25D 9/18 |
| 2012/0152581 | A1 | 6/2012 | Pillers, II et al. | |
| 2012/0187639 | A1 | 7/2012 | Steinke et al. | |

OTHER PUBLICATIONS

Vulcan Attachments; "Hydraulic Breaker Vulcan V30GS Operation & Maintenance Manual", published Jul. 2011 in Canada, 56 pages.

* cited by examiner

VALVE BODY CHARGE LOCK

TECHNICAL FIELD

The present disclosure relates to hydraulic hammers and other work tools that use a compressed gas to power the movement of tools. More specifically, the present disclosure relates to devices and methods for releasing a compressed gas from such tools and disassembling such tools.

BACKGROUND

Hydraulic hammers are generally known to include a tool extending partially out of a housing. Such hammers may include a hydraulically actuated power cell having an impact system operatively coupled to the tool. The impact system generates repeated, longitudinally directed forces against a proximal end of the tool disposed inside the housing. The distal end of the tool, extending outside of the housing, may be positioned against rock, stone, or other materials, thereby to break up those materials. During operation, the hydraulic hammer will form large pieces of broken material as well as stone dust and fine grit.

Many hydraulic hammers or other types of powered hammers use a compressed gas or other type of compressed fluid. In many applications, compressed nitrogen is used that is found above the piston in the accumulator that is important for the correct operation of the hammer. In particular, the presence of the nitrogen is important for providing the desired blow or impact energy and hydraulic efficiency of the hammer. Over time, the nitrogen may leak. Alternatively, an event that causes damage to the hammer may cause some leakage of the nitrogen charge or some other component of the hammer may need replacement or rework.

Therefore, it is necessary to perform maintenance on such hydraulic hammers periodically that may necessitate the disassembly of the hammer. Disassembly of the hydraulic hammer requires that the nitrogen contained in the accumulator be released or discharged prior to removing the valve body from the front head. This prevents an unwanted discharge of the nitrogen during disassembly that may cause the disassembly to be unwieldy. Currently, nothing prevents this disassembly if the nitrogen has not been discharged.

SUMMARY OF THE DISCLOSURE

A locking valve body assembly for use with a powered hammer assembly is provided. The valve body assembly comprises a valve body that defines a void configured to contain a pressurized fluid, and a locking member that is configured to be biased by the pressurized fluid into a locking configuration.

A powered hammer assembly is provided that comprises a housing, a power cell that includes a piston, and a locking valve body assembly that includes a valve body that defines a void that is configured to contain a pressurized fluid, a locking member that is configured to be biased by pressurized fluid into a locking configuration, and a retainer member. The housing defines a first aperture that is configured to receive the locking member, and the housing further defines a retaining slot that is configured to receive the retainer member.

A method of regulating the disassembly of a component from a powered tool assembly that uses a pressurized fluid and a locking member that is in operative association or communication with the fluid is provided. The method comprises biasing the locking member into a locked configuration using the pressurized fluid, preventing movement of the component in a first predetermined direction.

DETAILED DESCRIPTION

Figure 2:
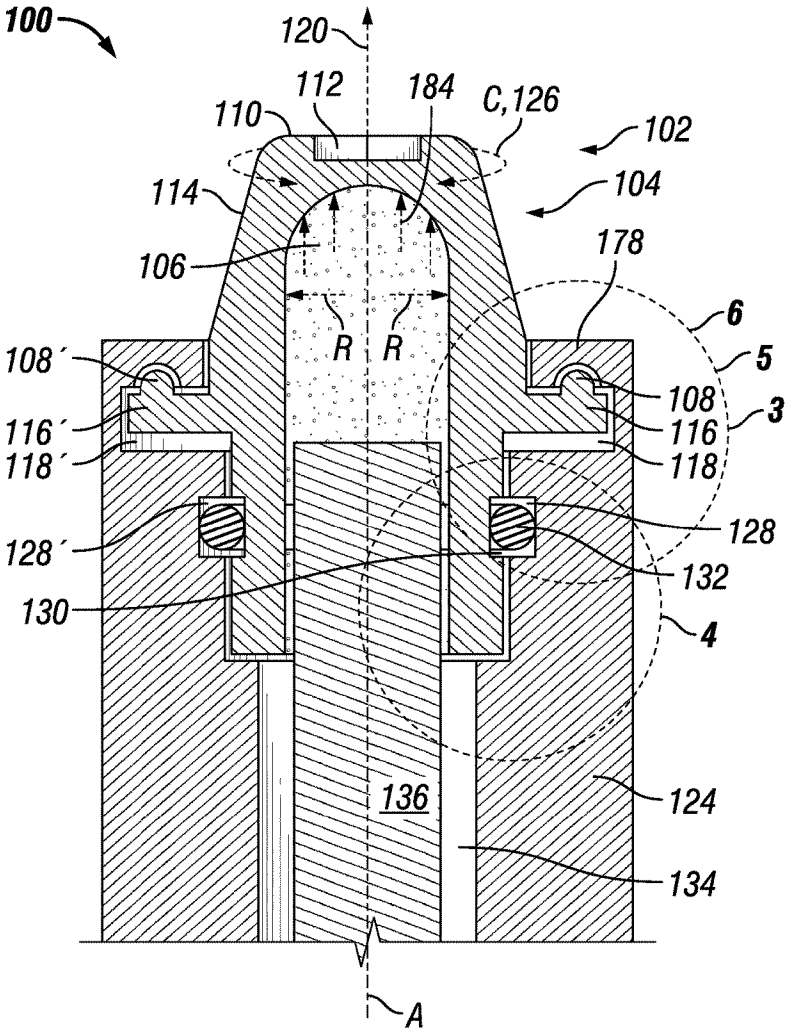
FIG. 2 is a cross-sectional view of the locking valve body assembly of FIG. 1 taken along lines 2-2 thereof.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

A hydraulic hammer assembly or other powered hammer or powered tool assembly may include a fail-safe locking mechanism that is powered by a pressurized fluid contained in the powered tool assembly, preventing disassembly of the powered tool assembly before the pressurized fluid has been sufficiently discharged or released. In other words, the existing charge of pressurized fluid acts to lock or prevent the disassembly of the apparatus. Various embodiments of the fail-safe locking mechanism will now be described.

Figure 1:
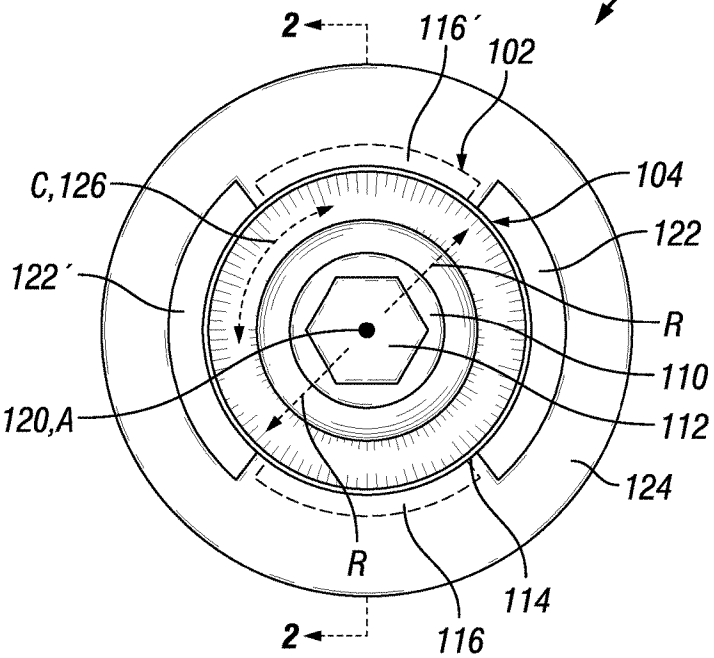
FIG. 1 is a is a top view of a locking valve body assembly that includes a fail-safe locking mechanism powered by pressurized fluid according to various embodiments of the present disclosure shown in a locked configuration.

Looking at FIGS. 1 and 2, a locking valve body assembly 102 for use with a powered tool assembly 100 that uses a pressurized fluid can be seen that includes a valve body 104 that defines a void 106 configured to contain a pressurized fluid and a locking member 108 that is configured to be biased by the pressurized fluid into a locking configuration. The valve body 104 may include a top surface 110 that defines a hexagonal pocket 112 that provides a drive structure for rotating the locking valve body assembly 102 from the locked configuration as shown in FIG. 1, to an unlocked configuration as will be described with reference to FIG. 7 later herein. Other types of drive structures that are known or that will be devised in the art could also be used such as wrench or torx configurations, etc. Alternatively, the exterior perimeter 114 of the valve body 104 itself could be knurled or provided with other gripping features to allow movement of the locking valve body assembly 102 manually without the need of a tool.

Figure 7:
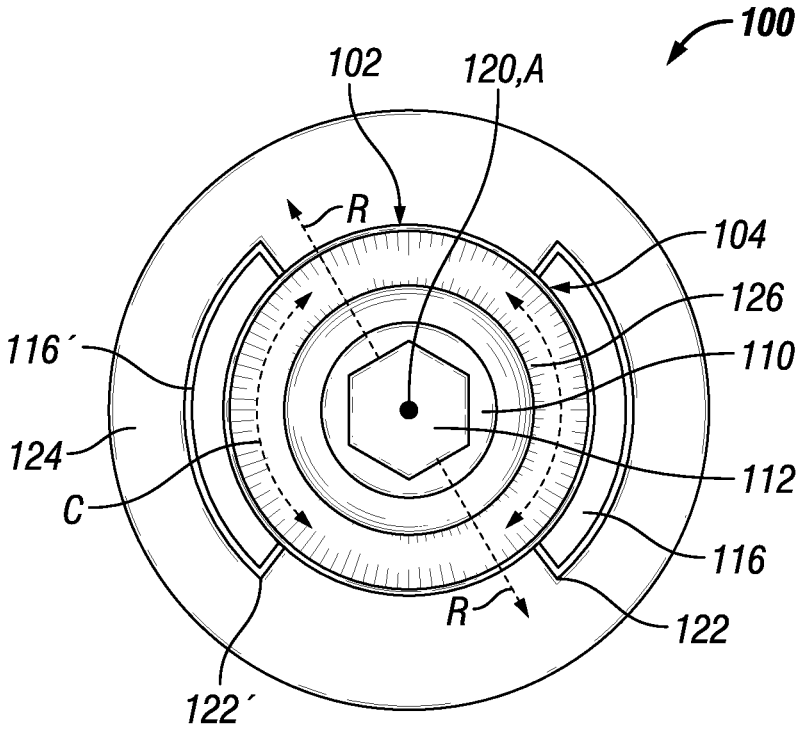
FIG. 7 is a is a top view of the locking valve body assembly of FIG. 1 shown in an unlocked configuration.

Focusing on FIG. 1, the locking valve body assembly 102 further comprises a retainer member 116 (shown by hidden lines) that is configured to mate with a corresponding feature of a powered tool assembly 100 such as a retaining slot 118 (see FIG. 2), preventing the locking valve body assembly 102 from being removed from the power tool assembly 100 along a first predetermined direction 200. Slots 122 are defined by the top surface 124 of the housing 124 that allow removal of the locking valve body assembly 102 when the retaining members 116 are aligned with the slots 122 as best seen in FIG. 7. For this embodiment, the locking valve body assembly 102, retainer member 116 and housing 124 are substantially cylindrical, defining an axis A of rotation. However, other configurations and directions of movement are possible for other embodiments of the present disclosure. Looking at FIGS. 1 and 2, the housing 124 of the power tool assembly 100 and the locking valve body assembly 102 also define a radial direction R and a circumferential direction C, which would also correspond to the directions 126 of rotation of the locking valve body assembly 102. The radial direction R is perpendicular to the axis A of rotation and to the tangent of the circumferential direction C. Accordingly, all three directions are different one from another.

The housing 124 and valve body 104 also define slots 128, 130 that receive an O-ring or other type of seal that prevent the escape of the pressurized fluid contained in the locking valve body assembly 102 or the housing 124. As used herein, a "fluid" is defined in a manner consistent with classic fluid mechanics, and includes gases and liquids of all types that deform continuously as a shear stress is applied to them. A piston 136 is disposed in the central bore 134 of the housing 124 and the void 106 of the valve member assembly 102 in a manner known in the art.

Figure 3:
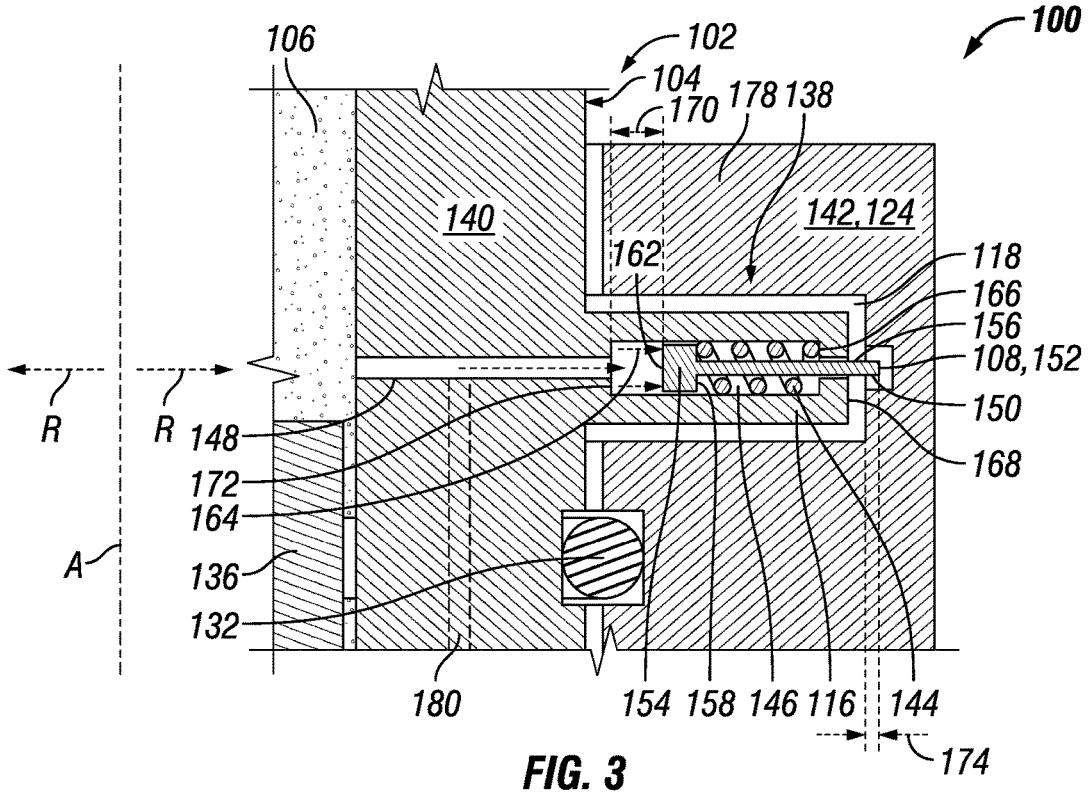
FIG. 3 is an enlarged detail view of area 3 of FIG. 2, showing a fail-safe locking mechanism according to one embodiment of the present disclosure.

Turning the reader's attention now to FIG. 3, an embodiment of a fail-safe locking mechanism 138 according to a first embodiment of the present disclosure may be more clearly seen. The retainer member 116 extends from the main wall 140 of the valve body 104 in the radial direction R into the retaining slot 118 that is at least partially complimentary shaped to the retainer member 116. The retaining slot 118 is defined by the sidewall 142 of the housing 124. A spring 144 is shown that is configured to bias the locking member 108 into an unlocked configuration. The retainer member 116 defines a first bore 146 that is configured to contain the locking member 108 and the spring 144, and the valve body 104 further defines a second bore 148 that is in fluid communication with the void 106 and the first bore 146. Both bores 146, 148 and the locking member 108 extend in the radial direction R, allowing the locking member 108 to extend and move or translate in the radial direction R. The pressurized fluid naturally flows into the second bore 148 and then into the first bore 146 where the locking member 108 is contained, pushing the locking member 108 against the spring force such that a portion of the locking member 108 enters a locking aperture 150 that is defined in the sidewall 142 of the housing 124 as the locking member 108 moves in an outward radial direction R.

More specifically, the locking member 108 of FIG. 3 comprises a locking pin 152 that includes a head 154 and a shaft 156. The diameter of the head may be closely toleranced to match the diameter of the first bore 146 to limit the amount of pressurized fluid acting on the annular surface 158 of the head 154 that would tend to move the locking pin 152 in the inward radial direction R along with the spring force, counteracting the locking force 164 exerted on the full circular area 162 of the head 154 disposed on the other side of the head 154. This also may limit the egress of the pressurized fluid over time, which could require recharging of the pressurized fluid into the powered tool assembly 100.

Even if gas should escape around the head of the pin, the difference in area from the left side of the head in FIG. 3 to that of the right side of the head of FIG. 3, might still be great enough to create enough force to move the locking pin into the locked configuration.

Focusing on the first bore 146, it may be characterized as a cylindrical pocket with an annular surface 166 proximate the radial extremity 168 of the retainer member 116. The compression spring 144 may be seated against this surface while the other end of the spring pushes against the annular surface 158 of the head 154, biasing the pin 152 into an unlocked configuration once the force 164 created by the pressurized fluid is removed. This may happen when the pressurized fluid is discharged or released from the power tool assembly 100. Of course, the minimum distance 170 from the head 154 of the locking pin 152 to the annular surface 172 formed by the first bore 146 proximate its intersection with the second bore 148 must me greater than the maximum distance 174 that the shaft 156 of the locking pin 152 extends into the locking aperture 150.

It should be noted that a third bore 176 communicates from the first bore 146 to the retaining slot 118, allowing the shaft 156 of the pin 152 to extend from radial extremity 168 of the retainer member 116, through the retaining slot 118, which is in communication with the atmosphere as the fail-safe locking mechanism 138 shown in FIG. 3 is located above the seal 132, and into the locking aperture 150. Therefore, it is contemplated that another seal may be provided above the fail-safe locking mechanism 138 such as will be discussed later herein with respect to FIG. 5.

Put into more general terms, the locking member 108 may be described as being operatively associated with the retainer member 116 and the locking member 108 may be configured to prevent movement of the retainer member 116 in a second predetermined direction, such as the circumferential direction C in this case. Also as best seen in FIG. 1, the retainer member 116 may be located below the flange 178 of the powered tool housing 124, which creates an overhang providing an undercut in a direction that is parallel with the axis A of rotation that prevents movement of the retainer member 116 or valve body 104 in the first predetermined direction such as along the axis A of rotation once this undercut is engaged by rotating the retainer member until the rotating member is under the flange.

It is further contemplated that if enough locking members with sufficient strength are used that can withstand the vertical force of the pressurized fluid, then a retainer member may not be necessary or used.

Figure 4:
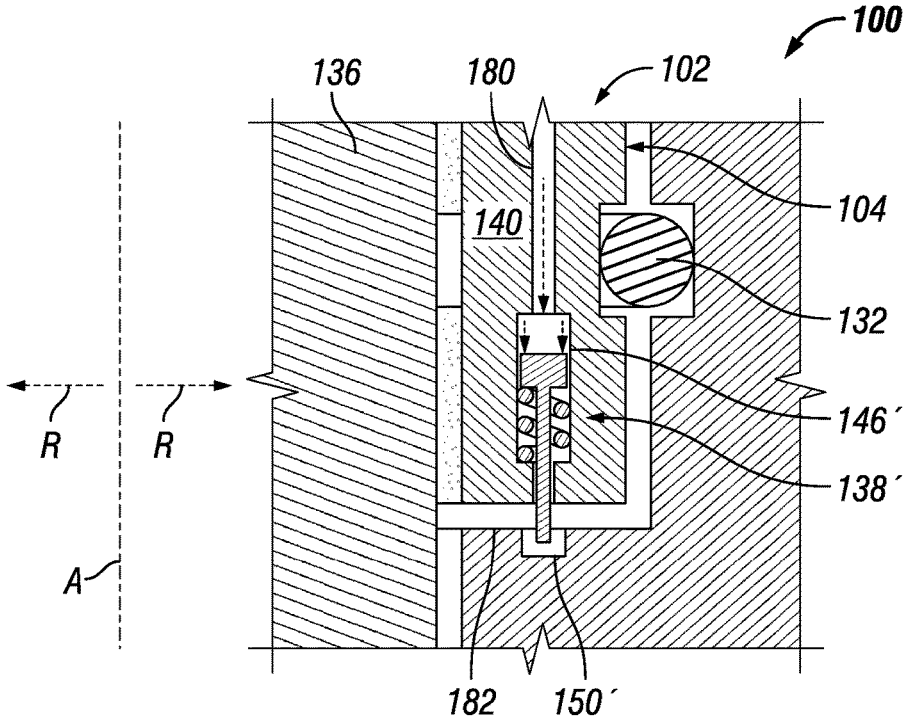
FIG. 4 is an enlarged detail view of area 4 of FIG. 2, showing a fail-safe locking mechanism according to another embodiment of the present disclosure.

FIG. 4 shows another embodiment of a fail-safe locking mechanism 138' that works in a similar manner as that in FIG. 3 except for the following differences. As best seen in FIG. 3, a vertical bore 180 is provided that extends down from the second bore 148 which may be blind for this embodiment. The vertical bore 180 is shown by hidden lines in FIG. 3 and communicates with the first bore 146' (see FIG. 4) that is similarly constructed as the first bore 146 of FIG. 3 except that it is defined in the main wall 140 of the valve body 104 and extends in a direction that is parallel with the axis A of rotation of the valve body 104. Similarly, the locking aperture 150' is defined by an annular surface 182 having a surface normal that is also parallel with the axis A of rotation while the locking aperture 150 of FIG. 3 is defined by a circumferential surface that has a surface normal that is parallel with the radial direction R. Also, the fail-safe locking mechanism 138' of FIG. 4 is positioned below the seal 132, diminishing the risk of the egress of the pressurized fluid from the powered tool assembly 100 without needing another seal located above the retainer member 116.

For the embodiments of the locking valve body assembly and fail safe locking mechanism for FIGS. 3 and 4, the locking member has been a separate moving part from the retainer member and valve body, which are integral with each other. On the other hand, FIGS. 5 and 6 show that the locking member may be integral with the retainer member and the retainer member may be integral with the valve body simultaneously.

Figure 5:
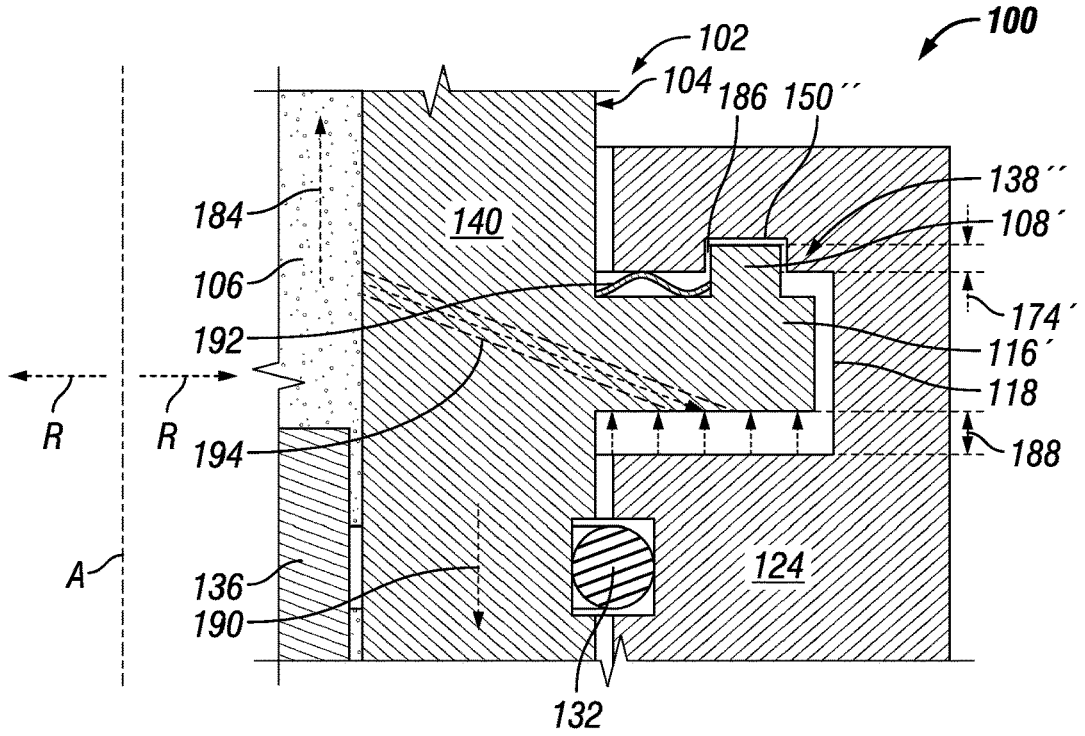
FIG. 5 is an enlarged detail view of area 5 of FIG. 2, showing a fail-safe locking mechanism according to yet another embodiment of the present disclosure.
Figure 6:
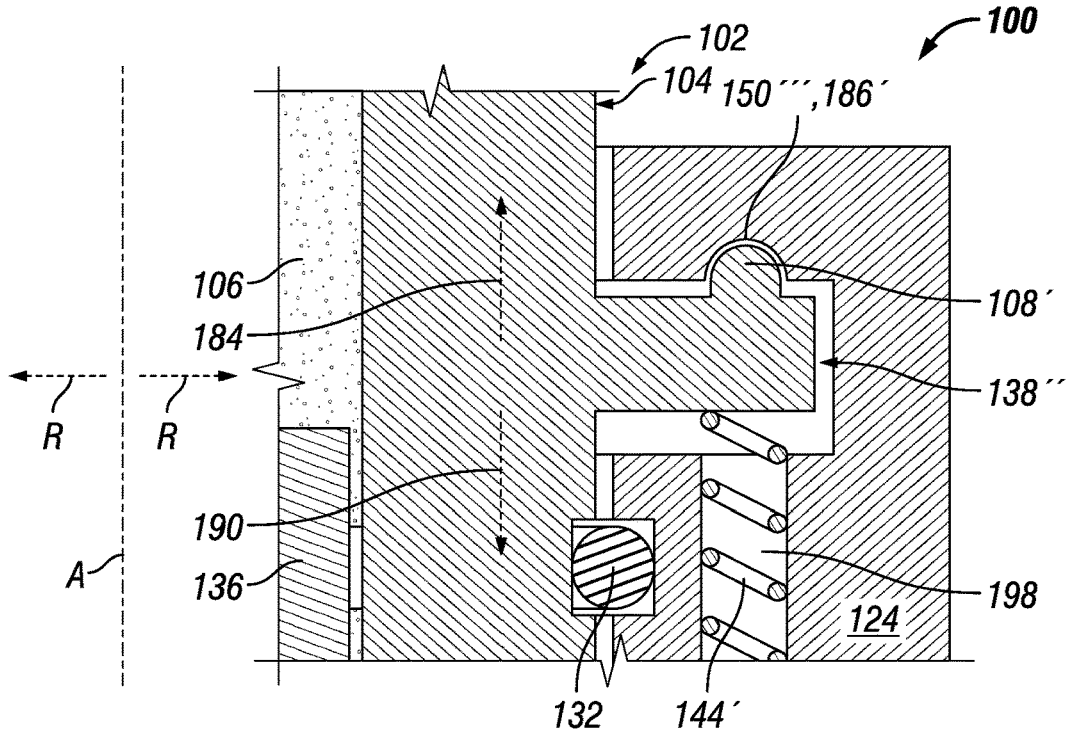
FIG. 6 is an enlarged detail view of area 6 of FIG. 2, showing a fail-safe locking mechanism according to yet a further embodiment of the present disclosure.

FIG. 5 illustrates another fail safe locking mechanism 138". The retainer member 116' may extend radially from the main wall 140 of the valve body 104 and the locking member 108' may extend in an upward direction parallel with the axis A of rotation of the valve body 104 from the retainer member 116. An upward force 184 that is exerted on the upper arched surface of the void 106 of the valve body 104 as best seen in FIG. 2, may be naturally created by the pressurized fluid contained in the void, causing the valve body 104 to move upwardly until the locking member 108' extends into a locking aperture 150" that is defined by a sidewall 186 that prevents rotation of the locking valve body assembly 102 about the axis A of rotation. Once this force is removed by discharging or releasing the gas, then the valve body 104 may move downwardly (see arrow 190 in FIG. 5) under the force of gravity or by pushing downwardly on the valve body 104 manually.

Provided that the distance 188 from the bottom surface of the retainer member 116' to the bottom surface of the retaining slot 118 is greater than the distance 174' that the locking member 108' extends into the locking aperture 150", the locking member 108' will clear the sidewall 186 of the locking aperture 150" as the valve body 104 moves downwardly, allowing the valve body 104 to be rotated until the retainer member 116 is aligned circumferentially with the disassembly slots 122 of the housing 124 as best seen in FIG. 7. Then the locking valve body assembly 102 may be removed from the powered tool assembly 100 by moving it away from the housing 124 along the axis A of rotation.

FIG. 5 also shows that a disc spring 192 may be trapped between the top surface of the retainer member 116' and the top surface of the retaining slot 118, providing a force that naturally biases the valve body 104 and locking member 108' into a position where the valve body is free to rotate. Also, an angled bore 194 may be provided from the void 106 to the bottom surface of the retainer member 116', providing upward locking force locally to the retainer member and locking member. This feature may not be necessary. In such an embodiment that uses such a feature, a spring energized gasket may be disposed where the disc spring 192 is shown and/or a liner spring seal may be employed in the vertical clearance groove 196 between the valve body 104 and the housing 124 to help limit the egress of the pressurized fluid.

Looking now at FIG. 6, another fail safe locking mechanism 138'" similar to that shown in FIG. 5 is depicted except that a compression spring 144' is provided in a lower bore 198 of the housing 124 that extends upwardly in a direction that is parallel with the axis A of rotation that biases the locking member 108" into the locking aperture 150'" even after the upward force 184 of the pressurized fluid is removed. The locking member 108" has a curved outline instead of the square outline of FIG. 5, to help lead it into the locking aperture. To unlock the locking valve body assembly 102 of FIG. 6, downward manual force 190 must be exerted until the spring force is overcome, moving the valve body 104 downwardly until the locking member 108" is no longer trapped in the locking aperture 150" by its sidewall 186', allowing the locking valve body assembly 102 to rotate to achieve the unlocked configuration shown in FIG. 7.

The locking pin, return spring and bore for holding the locking pin and return spring are shown contained directly in the valve body. In FIGS. 3 and 4. In some applications, an insert that contains one or more of these features would be pressed into a bore of the valve body, screwed into the bore, or otherwise be attached to the valve body in order to ease assembly and manufacture.

INDUSTRIAL APPLICABILITY

In practice, a locking valve body assembly or a fail-safe locking mechanism may be sold, manufactured or otherwise provided to retrofit or repair a powered tool assembly such as a powered hammer tool assembly. Also, a new powered hammer assembly may be sold or otherwise provided using any embodiment of a locking valve body assembly or a fail-safe locking mechanism as disclosed herein.

Figure 8:
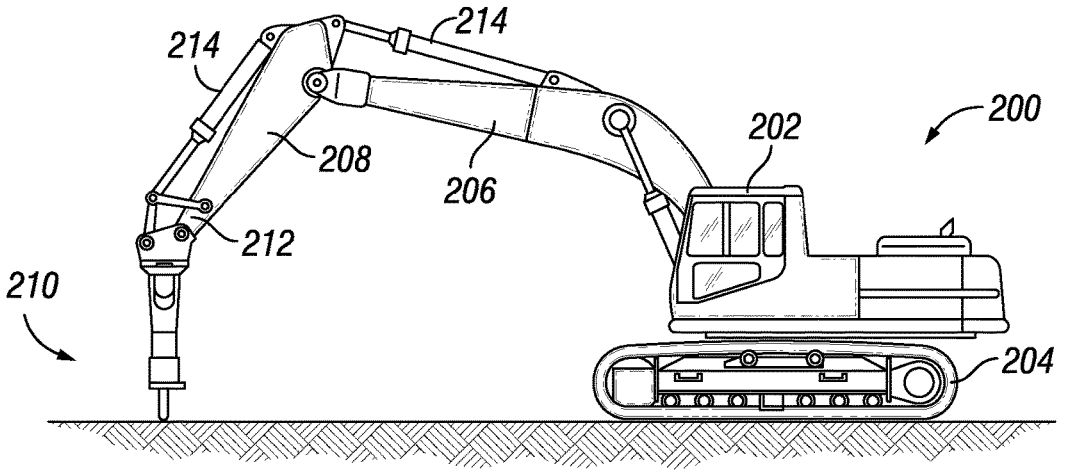
FIG. 8 is a front view of an excavating machine using a hydraulic hammer assembly that uses a locking valve body assembly with a fail-safe locking mechanism according to various embodiments of the present disclosure.
Figure 9:
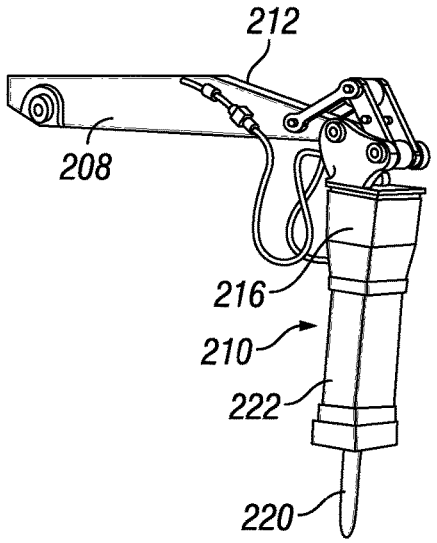
FIG. 9 is a perspective view of the hydraulic hammer assembly and part of the stick of the machine of FIG. 8 shown in isolation from the machine.
Figure 10:
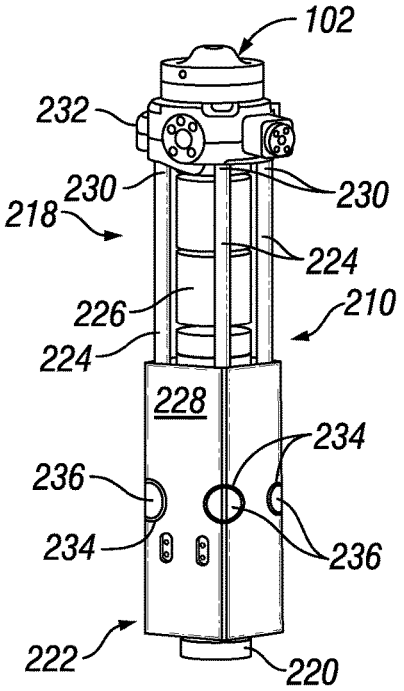
FIG. 10 is a perspective view of the hydraulic hammer assembly of FIG. 2 with part of the exterior housing removed, showing more clearly the tie rods that hold the assembly together, the power cell, and the locking valve body assembly.

FIGS. 8 thru 10 illustrate an application of the locking valve body assembly and fail safe locking mechanisms discussed thus far with reference to FIGS. 1 thru 7. Many other applications are possible and are therefore to be understood as also being within the scope of the present disclosure.

Referring initially to FIG. 8, an excavating machine 200 of a type used for digging and removing rock and soil from a construction worksite is shown. The excavating machine 200 may incorporate a cab body 202 containing an operator station, an engine, and operating controls (not depicted). The machine 200 may be supported by, and may move on, tracks 204. An extensible boom 206 may be movably anchored to the cab body 202, and an articulating stick 208, also sometimes called a lift arm, may be secured to and supported for movement on the boom 206. The excavating machine 200 may incorporate a hydraulic hammer assembly 210 as depicted, or may alternatively incorporate another implement, at an operational end 212 of the stick 208. Hydraulic cylinder actuators 214 may be utilized to move the stick 208 relative to the boom 206, and to move the hydraulic hammer assembly 210 relative to the stick 208.

Referring now also to FIG. 9, the hydraulic hammer assembly 210 may be secured to the operational end 212 of the stick 208. The hydraulic hammer assembly 210 may include an upper portion 216 that includes a power cell 218 shown below in FIG. 3 and a lower so-called front head portion 222 secured to the power cell 218. A hammer tool 220 having an upper end (not shown) may be retained within the front head portion 222. The hammer tool 220 may be adapted to produce cyclic vibrational movement at an intensity sufficient to demolish rocks, for example. The functional parts of the hydraulic hammer assembly 210, including the hammer tool 220 may be constructed of a forged or otherwise hardened metal such as a refined steel, for example, to assure appropriate strength, although other suitable materials such as diamond bits for operative portions of the hammer tool 220, for example, may be utilized within the scope of this disclosure.

Referring now also to FIG. 10, the hydraulic hammer assembly 210 is shown alone, i.e. detached from the stick 208 and with its exterior case covers removed, to reveal an exposed power cell 218, and a plurality of tie rods 224 circumferentially disposed about a cylindrical piston-containing sleeve structure 226. The sleeve structure 226 may contain a piston (not shown) adapted to drive the hammer tool 220. As such, the power cell 218 may be effective to utilize a suitable working fluid, such as a hydraulic and/or pneumatic fluid, for example, to reciprocally impact the piston against the upper end (not shown) of the hammer tool 220. It may also be appreciated that the plurality of tie rods 224 may be effective to retain or hold the power cell 218 and the front head portion 222 together under harsh impact loads as may be experienced within the hydraulic hammer assembly 210. In addition, a locking valve body assembly may be employed at the top of the hydraulic assembly as described herein.

The lower front head portion 222 may define an actual front head 228, which may function as a structural housing to support the upper end (not shown) of the hammer tool 220 (shown only fragmentarily in FIG. 3). An upper end 230 of each of the tie rods 224 may be secured to an upper structure or upper head 232 of the power cell 218. Each tie rod 224 may have a threaded lower end (not depicted) that extends downwardly through a vertically oriented aperture or tie rod bore 234 within the front head 222. The tie rod bore 234 defines a longitudinal axis of the installed tie rod 224. Each tie rod 224 may be adapted to be threadedly secured to a tie rod nut 236.

With continued reference to FIGS. 1 thru 7 and combining the understanding derived from them and applying it to FIGS. 8 thru 10, it can be see that a powered hammer assembly 100, 210 may be provided or assembled that comprises a housing 124, a power cell 218 that includes a piston 136, and a locking valve body assembly 102 that includes a valve body 104 that defines a void 106 that is configured to contain a pressurized fluid, a locking member 108 that is configured to be biased by pressurized fluid into a locking configuration, and a retainer member 116. The housing 124 defines a first aperture 150 that is configured to receive the locking member 108, and the housing 124 further defines a retaining slot 118 that is configured to receive the retainer member 116.

In some embodiments, the valve body 104 and retainer member 116 define an axis A of rotation and a radial direction R and the locking member 108 is configured to translate in the radial direction R or along a direction that is parallel with the axis A of rotation. In other embodiments, the valve body 104 and retaining member 116 are integral with each other.

In yet further embodiments, the retainer member 116 defines a bore 146 that is configured to receive the locking member 108 and the valve body 104 defines a bore 148 that communicates from the void 106 of pressurized fluid to the bore 146 of the retaining member 116. The powered hammer assembly 100, 210 may further comprise a spring 144 that is configured to bias the locking member 108 into an unlocked configuration. The locking member 108 may include a pin 152 that comprises a shaft 156 and a head 154.

Figure 11:
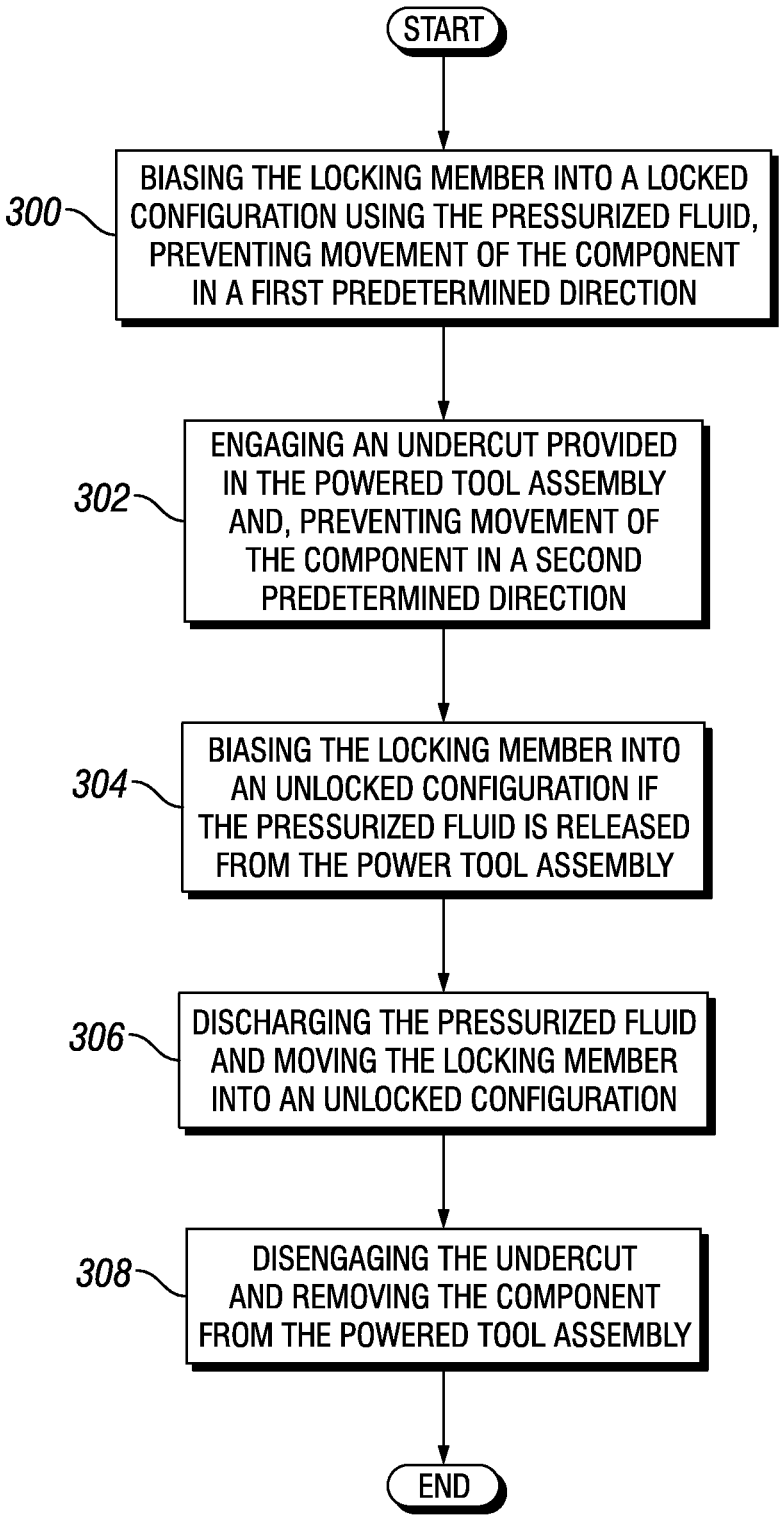
FIG. 11 is a flowchart depicting a method of regulating the disassembly of a component from a powered tool assembly that uses a pressurized fluid.

The various embodiments of the apparatus described herein may be use with a method of regulating the disassembly of a component from a powered tool assembly as shown in the flowchart of FIG. 11, which uses a pressurized fluid and a locking member that is in operative association or communication with the fluid. In the broadest sense, any component, including the valve body or another component may be used with this method and the locking member may be in direct contact with the pressurized fluid or may be moved by another mechanism interposed between the locking member and the fluid, etc.

The method may comprise biasing the locking member into a locked configuration using a pressurized fluid, preventing movement of the component in a first predetermined direction (see step 300). The method may further comprise providing an undercut in the powered tool assembly and engaging that undercut, preventing movement of the component in a second predetermined direction (see step 302). In some embodiments, the method may further comprise biasing the locking member into an unlocked configuration if the pressurized fluid is released from the powered tool assembly (see step 304). Next, the method may include discharging the pressurized fluid and moving the locking member into an unlocked configuration (see step 306). Then, the method may comprise disengaging the undercut and removing the component from the powered tool assembly (see step 308).

While most embodiments have been directed to those powered hydraulically, other powered hammer assemblies and powered tool assemblies are considered to be within the scope of the present disclosure including those that are mechanically or electrically driven, etc. Similarly, the embodiments discussed herein are typically cylindrical in configuration but other configurations are considered to be within the scope of the present disclosure.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A locking valve body assembly for use with a powered hammer assembly, the valve body assembly comprising:

a valve body that defines a void configured to contain a pressurized fluid and an axis of rotation, the valve body further including a top exterior surface and a drive structure on the top exterior surface for rotating the valve body from a locked configuration to an unlocked configuration about the axis of rotation; and a locking member that is configured to be biased by the pressurized fluid into a locking configuration, preventing the rotation of the valve body about the axis of rotation.

2. The locking valve body assembly of claim 1 further comprising a retainer member that is configured to mate with a slot of a powered hammer assembly, wherein the locking valve body assembly is configured to prevent the retainer from being removed from the power hammer assembly along the axis of rotation.

3. The locking valve body assembly of claim 2 wherein the valve body and retainer member define a radial direction that is perpendicular to the axis of rotation.

4. The locking valve body assembly of claim 3, wherein the locking member is configured to move in the radial direction.

* * * * *